United States Patent [19]

McGlew

[11] Patent Number: 4,817,345

[45] Date of Patent: Apr. 4, 1989

[54] BUILDING HAVING MOVABLE RESTAURANT

[76] Inventor: John J. McGlew, P.O. Box 823 (E. Lake Rd.), Tuxedo Park, N.Y. 10997

[21] Appl. No.: 398,596

[22] Filed: Jul. 15, 1982

[51] Int. Cl.[4] ..... E04H 3/04

[52] U.S. Cl. ..... 52/36; 52/64; 52/65; 52/73

[58] Field of Search ..... 52/64, 65, 36, 73, 234, 52/236.2, 236.3, 272, 273

[56] References Cited

U.S. PATENT DOCUMENTS

| | | | |
|---|---|---|---|
| 3,091,815 | 6/1963 | Krawiec | 52/31 |
| 3,156,017 | 11/1964 | Faerber | 52/236.3 X |
| 3,246,431 | 4/1966 | Faerber | 52/73 X |
| 3,388,513 | 6/1968 | Bauer | 52/236.2 X |
| 3,633,904 | 1/1972 | Kojima | 52/65 X |
| 3,733,763 | 5/1973 | Drucker | 52/73 X |

FOREIGN PATENT DOCUMENTS

| | | | |
|---|---|---|---|
| 878807 | 8/1971 | Canada | 52/65 |
| 4415344 | 7/1969 | Japan | 52/65 |
| 404168 | 6/1966 | Switzerland | 52/65 |

OTHER PUBLICATIONS

Interbuild, vol. 6, No. 3, p. 10, Mar. 1959, a copy in G.A.U354, 52/65.

*Primary Examiner*—John E. Murtagh

*Attorney, Agent, or Firm*—McGlew and Tuttle

[57] ABSTRACT

A building structure comprises a vertically extending guide and a restaurant dining car movable upwardly and downwardly in respect to the guide and having one or more dining tables for accommodating diners. The car advantageously has a wall with a window view so that diners upon entering the car and ordering their food may be moved upwardly to a higher elevation to enjoy the view during dining. The food preparation area is defined on its support structure adjacent the guide and it may for example remain at a ground level location or be located at an uppermost location. The food preparation center has a connection to the dining car for example in the form of a direct door connection from a central restaurant preparation area through a doorway into the dining area for service. In some instances it is desirable to have the food preparation and service area at a ground floor location and in such a case delivery of the food would be made from the food service area by means of dumbwaiters which would move upwardly along the guideway sometime after the dining car has begun its ascent and at a rate to overtake the dining car and provide the delivery of the food in the form of a buffet at a table or by direct service at any elevation of the car. The car is controlled to move preferably vertically upwardly and then to rotate at a high elevation and to descend all in the time permitting consumption of a meal.

7 Claims, 2 Drawing Sheets

BUILDING HAVING MOVABLE RESTAURANT

FIELD AND BACKGROUND OF THE INVENTION

This invention relates in general to a movable restaurant device and in particular to a new and useful building having a movable restaurant associated therewith which may transport a diner for example upwardly through a path affording a great view of the surrounding locations.

At the present time it is known to use elevated structures with guide supports for parking vehicles in which the vehicles are driven in at a street level location and moved vertically upwardly for temporary storage during the period in which they are left in the parking garage. While such an idea has not been employed with restaurants, it is known to have restaurants which are located at the top of a high building and which continuously move, for example rotate, during the time at which a diner is present in the restaurant car.

SUMMARY OF THE INVENTION

In accordance with the present invention there is provided a building structure which has a vertically extending guide length, for example an elevator shaft, along which a restaurant dining car is movable. The dining car has at least one wall with a window view and it is connected to a restaurant preparation area which may or may not move with the dining car and which for example may be in a fixed location either at a lower floor or an upper floor of the structure. An interconnection between the restaurant food preparation area and the dining car may be advantageously effected by a direct doorway connection of the car for example to a central area around which the car rotates or by means of dumbwaiters which are dispatched with a prepared food after the diners enter into the dining car and are moved upwardly through their viewing journey. The arrangement may be such as to permit payment by the diner for the meal, the serving of the meal and the enjoying of a beautiful vista or view during the meal as the car moves relative to the guide structure.

Accordingly it is an object of the invention to provide a building structure having a movable dining car structure associated therewith and which also includes a food preparation area which is in communication with the dining car either directly or through movable conveyors or dumbwaiters.

A further object of the invention is to provide an elevated structure adapted to carry a plurality of restaurant cars including a vertical guide ring over which the car is movable and preferably with a turnaround or rotational portion of the guideway to permit the restaurant car to move through a 360° angle or any portion thereof.

A further object of the invention is to provide a restaurant in which the dining car is serviced from a food area which may be associated directly with the dining car or in a separate location in a guide structure which for example is advantageously in the form of a building tower and wherein the dining car is movable along the guide structure to an elevated position and/or transported through a rotatable viewing phase and then returned to a ground level position and wherein the food is served directly from the car itself or separately through a service area located in a stationary part of the structure.

A further object of the invention is to provide an office building structure having an elevator guideway going up one side of the structure across to the other side and then downwardly on the opposite side.

A further object of the invention is to provide a building structure which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF PREFERRED EMBODIMENTS

Figure 3:
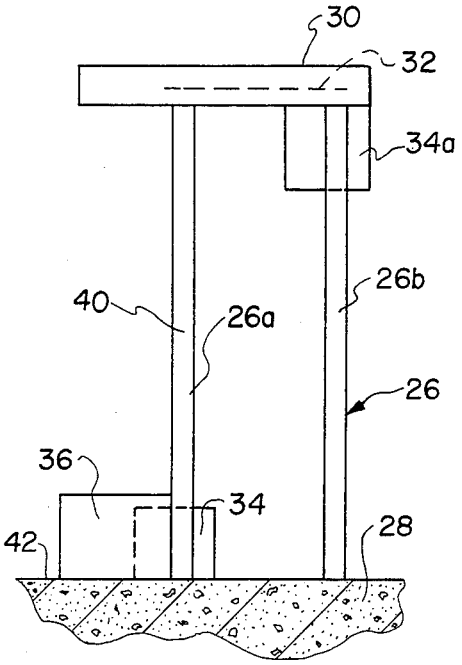
FIG. 3 is a schematic elevational showing of another embodiment of the invention.

Referring to the drawings in particular the invention embodied therein comprises a building structure generally designated 10 which includes means defining a vertically extending guide 12 which in the embodiment shown comprises a central building of multi stories which is centrally arranged in respect to a dining car generally designated 14. In the embodiment illustrated the dining car 14 is made up of a half circular segment which is guided by a cylindrically formed vertically extending guide or building 12. Dining car 14 is constructed to contain a plurality of dining tables 16 for accommodating diners which for example is accessible through a passage **12*c* for entrance and serving which is accessible for example at ground level of the building 12. The dining car 14 has at least one wall for example the curved wall 18 which has a window view such as a panoramic view which will be visible by all of the diners. After a diner enters the dining area 14*b* through the access opening 12*c* and is seated at a table 16 the dining car 14 is elevated in the direction of the arrow 20 by the usual guiderails and cables 22 defined on the exterior of the building 12. In some instances it is desirable to have one or more additional access openings 12*c* in the building 12 at several levels of the building for example every five floors to permit additional diners to enter the dining area 14*b* or to provide for service as the dining car 14 is moved upwardly. Preferably the dining car 14 moves all the way up to the top of the building to the location 14*c* indicated in dotted lines. In the embodiment shown the building 12 includes a horizontal trackway 24 on its exterior at the floor level indicated 12*d*. In some instances the floor level 12***d* is the only level at which service is carried out and this may comprise a central service area 12*d* having one or more access openings 12*c* through the dining car 14 as it is rotated on the horizontal trackway 24 around the top of the vertical support structure or building 12 to afford the diners an ideal view of the surrounding area for dining purposes.

In some instances it is desirable to design the dining car 14 so that a plurality of them may move upwardly and downwardly on the building at various angular positions as desired. More than one dining car 14 is arranged around the building and one of them may be at the top location revolving around at the top while the other is loading at the bottom station on the ground. In some instances instead of having separate service areas it is desirable to have a single service area either at 12*c* or 12*d* and to service the dining car at other levels through a dumbwaiter 21 which may run up and down in the building 12.

Figure 3A:
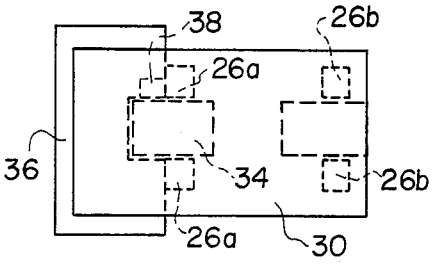
FIG. 3A is a top plan view of the device shown in FIG. 3.
Figure 1:
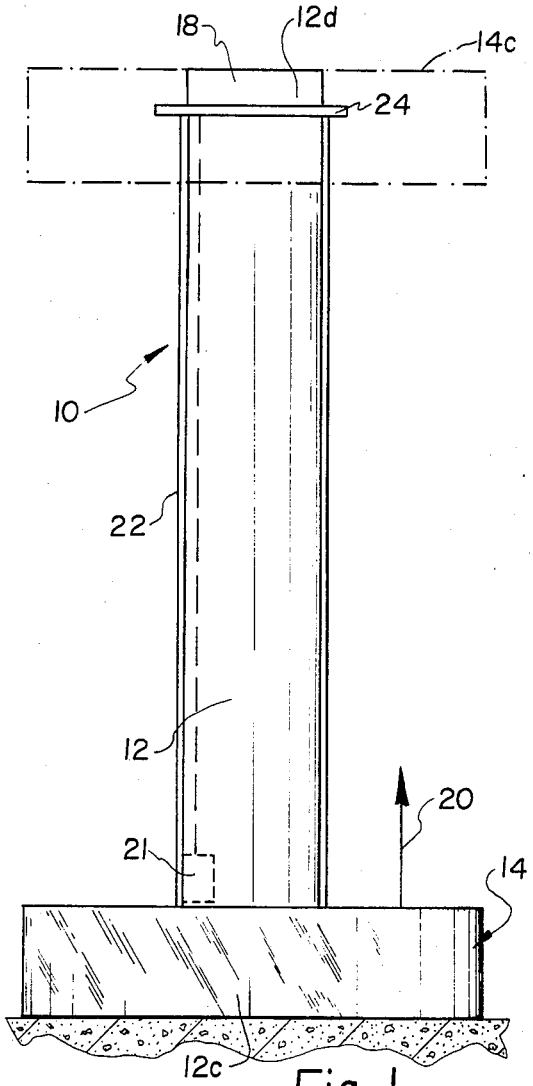
FIG. 1 is a schematic elevational view of a building structure constructed in accordance with the invention.
Figure 2:
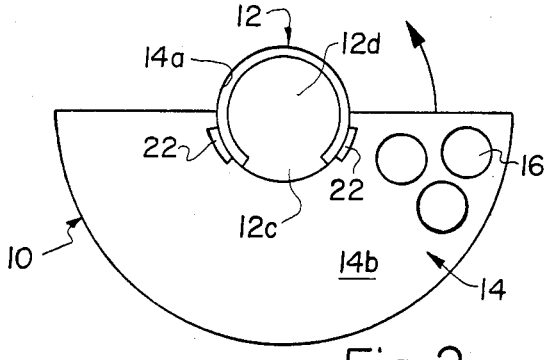
FIG. 2 is a top plan view partly in section of the building structure shown in FIG. 1.

In accordance with the embodiment of the invention shown in FIGS. 3 and 3A, the invention includes a building structure generally designated 26 which includes vertical support members 26*a* and 26*b* which are anchored in a ground foundation 28 and connected at their upper ends to a beam 30 carrying a horizontal trackway 32. The restaurant dining car 34 may be made large enough to accommodate its own service preparation area or it may be fastened as a travelling car. The dining car 34 is loaded through an access building 36 which may also be a preparation center for the food. Food that may be prepared in the access center 36 may for example be directed upwardly in a dumbwaiter 38 to whatever elevation the car 34 may be positioned. A suitable mechanism associated with a trackway 40 for the dumbwaiter may provide for movement of the dumbwaiter with the speed of the car after the initial order is sent up to the car 34. Another car 34*a* is shown which has moved from the vertical trackway 26*a* across the horizontal trackway 32 and downwardly along the trackway 36*b* in a direction toward the ground 42.

Figure 4:
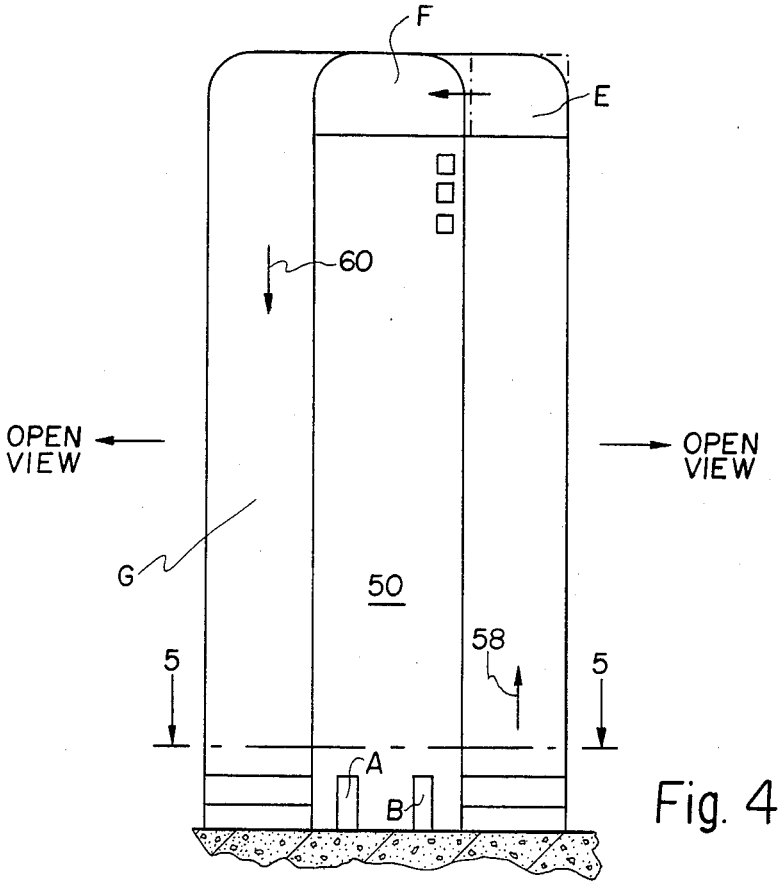
FIG. 4 is a view similar to FIG. 1 of still another embodiment of the invention.
Figure 6:
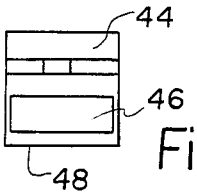
FIG. 6 is a horizontal sectional view of one embodiment of a dining car.
Figure 5:
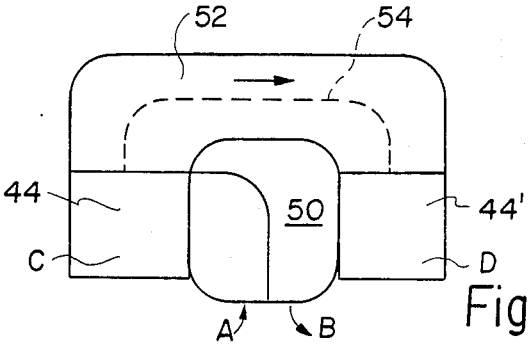
FIG. 5 is a section taken along the line 5—5 of FIG. 4.

In the embodiment of the invention indicated in FIGS. 4, 5 and 6, dining car 44 is made of a size just to accomodate a few people with a table 46 which is situated adjacent a viewing window 48. In this embodiment, a central office building 50 is provided with a framework 52 for accommodating the movement of the car 44 from the position shown at the left-hand side in FIG. 5 to the position shown at the right-hand side and designated 44'. The framework including a horizontal trackway 54 may be located either at ground level to shift the dining car relative to the building 50 or it may be located at the top or any intermediate floor of the building as desired. In the embodiment shown, a diner enters the restaurant at A through the building 50 and goes into a service area 56 and for example pays for the meal he orders from the menu. He is then permitted to enter into the elevated dining room and the meals may be either served directly to him at such time or provided during the travel of the cars at the dining room location C or it may be provided as the car moves around the horizontal trackway 54 to the location D. The care will then rise in the direction of the arrow 58 until the car moves to the position E at the top of the building. The car will then move through a similar trackway similar to the trackway 54 or one that goes completely around the building as desired until it moves over to a desired section of the building and descends in the direction of the arrow 60 back to the location of the original entrance into the dining car.

In accordance with the invention, the building structure may be associated with a building or it may be its own self-contained structure which provides a dining facility which enables the diner to enjoy a meal while he travels in a car upwardly in respect to his starting point into a location where he can view the surrounding area. The device would be particularly attractive for use in a seashore resort where one desires an excellent ocean view, in a city to enjoy the sights of the city, in a national park or point of interest or in any place where viewing and dining can be accomplished simultaneously.

While specific embodiments of the invention have been shown and described in detail to illustrate the application of the principles of the invention, it will be understood that the invention may be embodied otherwise without departing from such principles.

What is claimed is:

1. A building structure comprising means defining a vertically extending guide, a restaurant dining car for accommodating diners at a dining table associated with said guide for movement upwardly and downwardly therealong, said dining car having at least one wall with a window view, means defining a restaurant food preparation area adjacent said dining car, and food delivery means providing an interconnection between said dining car and said food preparation area, said structure including a central building, said vertically extending guide being carried by said building, said vertical guide including a trackway on said building for the movement of the car upwardly along said building on one side thereof, a horizontal trackway on said building permitting movement of said car laterally in respect to said building.

2. A building structure according to claim 1 including a second vertical section permitting movement of the laterally moved car downwardly from said building.

3. A building structure comprising means defining a vertically extending guide, a restaurant dining car for accommodating diners at a dining table associated with said guide for movement upwardly and downwardly therealong, said dining car having at least one wall with a window view, means defining a restaurant food preparation area adjacent said dining car, and food delivery means providing an interconnection between said dining car and said food preparation area, said vertically extending guide including an upwardly extending trackway portion for said dining car, a laterally extending trackway portion connected to the top of said upwardly extending portion and a downwardly extending portion connected to the top of said horizontally extending portion at the end thereof opposite to said upwardly extending portion and including an office building disposed centrally between said upwardly and downwardly extending portions.

4. A building structure according to claim 3, including a trackway defined around said building.

5. A building structure according to claim 3, wherein said trackway extending around said building is located at ground floor.

6. A building structure according to claim 3, wherein said trackway extending around said building is located at the uppermost floor of said building.

7. A building structure comprising a central building having a restaurant service area at the ground floor thereof, an elevator dining car arranged alongside said building adjacent said service area, means defining a vertical trackway for said elevator dining car alongside said building up to the top of said building, means defining a horizontal trackway extending from said vertical trackway laterally around said building, and a second vertical section for the descent of said dining car connected to the end of said horizontal trackway but remote from said first vertical section.

* * * * *